US005520152A

United States Patent [19]

Schoenfelder et al.

[11] Patent Number: 5,520,152

[45] Date of Patent: May 28, 1996

[54] METHOD AND DEVICE FOR CONTROLLING AN INTERNAL COMBUSTION ENGINE

[75] Inventors: Dietbert Schoenfelder, Gerlingen; Peter Lutz, Weinsberg; Roland Gronenberg, Leinfelden-Echterdingen; Peter Schmitz, Reiskirchen, all of Germany

[73] Assignee: Robert Bosch GmbH, Stuttgart, Germany

[21] Appl. No.: 469,340

[22] Filed: Jun. 6, 1995

[30] Foreign Application Priority Data

Jul. 18, 1994 [DE] Germany ..... 44 25 295.1

[51] Int. Cl.[6] ..... F02D 41/30; F02D 41/40

[52] U.S. Cl. ..... 123/478; 123/486

[58] Field of Search ..... 123/467, 472, 123/478, 486, 492, 498, 506, 446

[56] References Cited

U.S. PATENT DOCUMENTS

| | | | |
|---|---|---|---|
| 3,575,145 | 4/1971 | Steiger | 123/478 |
| 3,851,635 | 12/1974 | Murtin et al. | 123/478 |
| 4,615,322 | 10/1986 | Dazzi | 123/506 |
| 4,633,837 | 1/1987 | Babitzka et al. | 123/478 |
| 4,785,787 | 11/1988 | Riszk et al. | 123/506 |
| 4,903,669 | 2/1990 | Groff et al. | 123/478 |
| 4,958,610 | 9/1990 | Yamamoto et al. | 123/478 |
| 5,003,953 | 4/1991 | Weglarz et al. | 123/478 |
| 5,137,000 | 8/1992 | Stepper et al. | 123/478 |
| 5,261,366 | 11/1993 | Regueiro | 123/478 |

FOREIGN PATENT DOCUMENTS 4108639A 3/1991 Germany .

*Primary Examiner*—Willis R. Wolfe
*Attorney, Agent, or Firm*—Kenyon & Kenyon

[57] ABSTRACT

A device and a method for controlling an internal combustion engine, in particular a diesel internal combustion engine, having at least one solenoid valve, are described. On the basis of a desired quantity of fuel, an actuation period is determined for the solenoid valve and a signal for fixing the end of actuation is prescribed on the basis of the actuation period. Depending on the operating state of the internal combustion engine, the actuation period is determined either by means of a pump characteristic table or the desired quantity of fuel is used directly as the actuation period. Moreover, depending on the operating state of the internal combustion engine, either an uncorrected or a corrected signal is used for fixing the end of actuation.

9 Claims, 5 Drawing Sheets

METHOD AND DEVICE FOR CONTROLLING AN INTERNAL COMBUSTION ENGINE

FIELD OF THE INVENTION

The present invention relates to a method and a device for controlling an internal combustion engine, and in particular a diesel internal combustion engine having at least one solenoid valve.

BACKGROUND INFORMATION

German Published Patent Application No. 41 08 639 (the "'639 reference") describes a method and device for controlling an internal combustion engine, particularly a diesel internal combustion engine. In accordance with the '639 reference, the start and the end of the metering of fuel can be fixed by means of a solenoid valve.

With the device and method of the '639 reference, however, the control of injected fuel quantity is imprecise. In addition, under conditions which are otherwise constant, deviations occur in the quantity of fuel injected between the individual meterings.

SUMMARY OF THE INVENTION

An object of the present invention is to improve the precision of the metering of fuel in a method and a device for controlling an internal combustion engine. By means of the system according to the present invention, substantially more precise metering of fuel is possible.

DETAILED DESCRIPTION OF THE DRAWINGS

Figure 1:
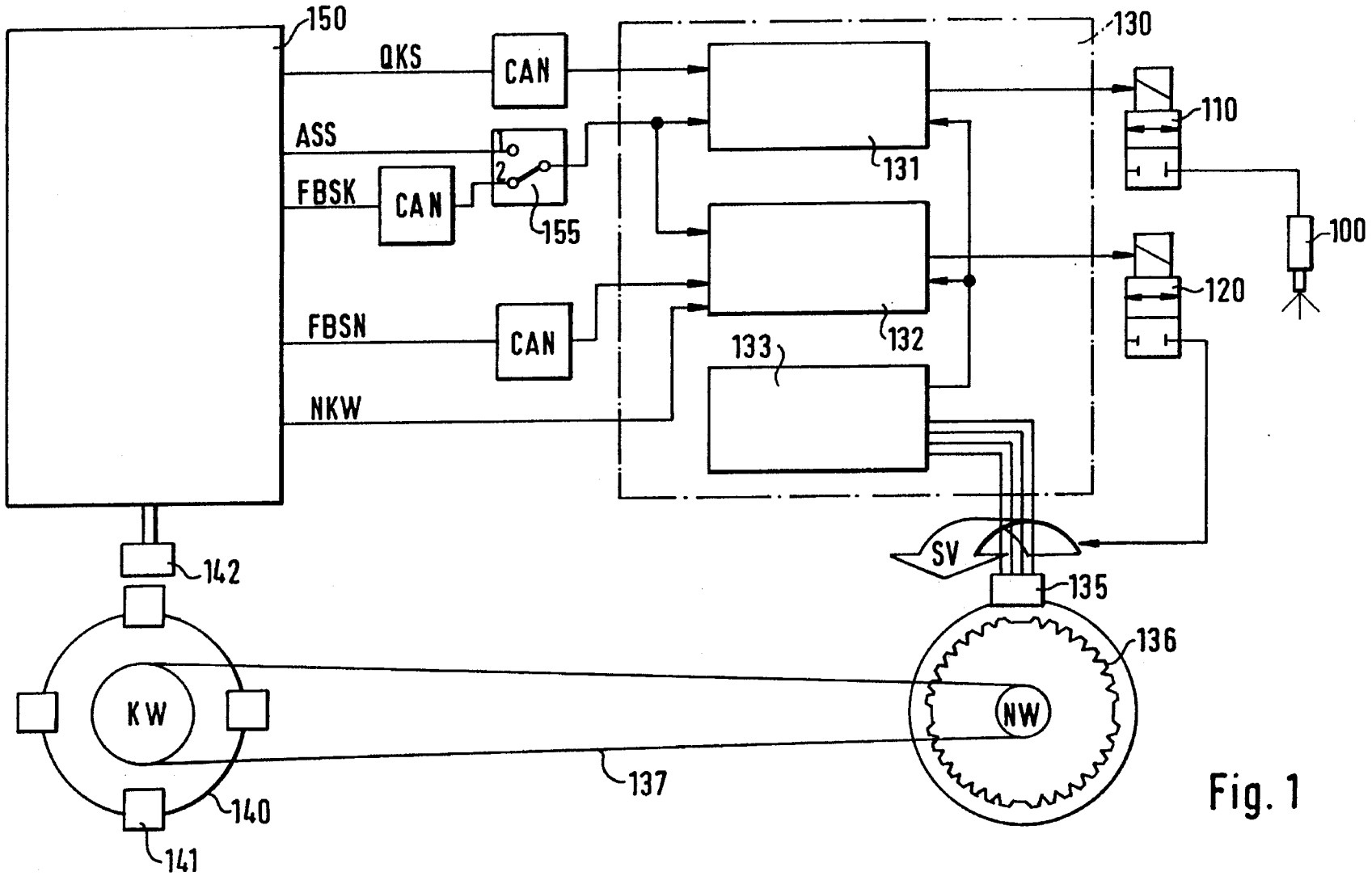
FIG. 1 shows a block diagram of a device according to the present invention.

FIG. 1 is a diagrammatic illustration of a device, in accordance with the present invention, for controlling an internal combustion engine, in particular a diesel internal combustion engine. By means of an injection valve 100, a specific quantity of fuel is metered to the internal combustion engine at a specific time. The precise start and end of the metering of fuel is fixed by means of a first actuator 110. The first actuator 110 is preferably a solenoid valve which controls the flow of fuel. The solenoid valve is preferably arranged in the region of a high pressure fuel pump and enables the flow of fuel or blocks the flow of fuel between a low pressure part and a high pressure part of the fuel pump.

As long as the solenoid valve 110 is closed, it is possible to build up pressure and thus feed fuel to the injection valve 100. As soon as the solenoid valve 110 opens, the metering of fuel ends.

The start of injection is fixed by the closing of the solenoid 110, and the end of injection, and thus the quantity of fuel metered, is fixed by the opening of the solenoid 110.

Furthermore, a second actuator 120 is provided by means of which the feed rate, i.e., the quantity of fuel injected for a given angular displacement of the camshaft, can be adjusted. The second actuator 120 is preferably also a solenoid valve, by means of which a build up or a reduction in pressure in a hydraulic actuator is made possible. This actuator displaces the relative arrangement of the crankshaft of the internal combustion engine and the pump drive shaft. This is preferably an actuator for displacing the cam disk in a distributor injection pump.

The first and second actuators are supplied with control signals from a pump control unit 130. The pump control unit comprises a fuel rate controller 131 which supplies the first actuator 110 with drive signals, an injection-timing drive 132 which supplies the second actuator 120 with signals, and an actual value counter evaluation device 133 which evaluates signals from a sensor 135.

The sensor 135 scans an increment wheel 136 which is arranged on the pump drive shaft or on the camshaft NW of the internal combustion engine. The increment wheel 136 comprises a plurality of marks which are arranged, for example, at intervals of 3°. The evaluation device 133 supplies a corresponding signal to the fuel rate controller 131 and the injection-timing drive 132.

The camshaft NW is usually driven by the crankshaft KW of the internal combustion engine via a drive means 137. A segment wheel 140 with a number of marks 141 corresponding to the number of cylinders is arranged on the crankshaft. The marks 141 are sensed by a sensor 142. The sensor 142 supplies the engine control device 150 with a signal NKW relating to the speed of revolution of the crankshaft.

The pump control device in turn is connected to an engine control device 150. The engine control device 150 supplies the pump control device with signals on the one hand via an interface, e.g., CAN, or via a direct line. The engine control device 150 transmits, via the interface CAN, a signal QKS which specifies the quantity of fuel desired by the engine control device.

The engine control device 150 further transmits a signal FBSK corresponding to a nominal value for the start of pump delivery which is related to the crankshaft. Furthermore, the engine control device 150 transmits a further desired value FBSN for the start of pump delivery which is related to the camshaft or the pump drive shaft and which sets the delivery rate.

A signal ASS is transmitted from the engine control device 150 to the pump control device 130 via a separate line which is independent of the interface. A selector 155 selects either the signal ASS or the signal FBSK. In the mode of operation considered here, the selector 155 is in the position designated by 1.

The engine control device 150 transmits a speed of revolution signal NKW, relating to the speed of revolution of the crankshaft, to the pump control device 130, or more specifically to the injection-timing drive 132.

This device operates as follows. The sensor 142 detects the speed of revolution of the crankshaft and calculates, on the basis of the speed of revolution and various further variables such as the position of the accelerator pedal, a desired value QKS for the quantity of fuel to be injected and a desired value for the start of pump delivery. In the case of the desired value for the start of pump delivery a distinction is made between a desired value FBSK which is related to the crankshaft and a value FBSN which is related to the camshaft.

The values FBSK and FBSN are converted by the pump controller 130 into drive signals for the first and second actuators. On the basis of the desired value for the quantity of fuel QKS and for the crankshaft-related desired value FBSK for the start of feeding, the fuel rate controller 130 evaluates a signal for driving the actuator 110. This is a signal AB which fixes the start of actuation or the start of the metering of fuel. Furthermore, it calculates a signal AE which fixes the end of actuation and thus the end of the metering of fuel. The injected quantity of fuel is also defined by the start and the end.

The injection-timing drive 132 calculates, on the basis of the desired values FBSK and FBSN for the start of feeding, a signal for actuating the second actuator 120. The desired value for the start of feeding FBSK, which value is related to the crankshaft, specifies the angular position of the crankshaft at which the metering of fuel must start in order to achieve optimum combustion. The desired value for the start of feeding FBSN, which is related to the camshaft, specifies the angular position of the pump drive shaft at which the injection is to begin. The feed rate depends on this value. By means of the second actuator 120, the pump drive shaft is displaced with respect to the crankshaft.

At different values for the desired value FBSN of the start of feeding, which is related to the camshaft, different feed rates are obtained. This means that, with the same start AB of actuation and with the same end AE of actuation, different injected quantities of fuel are obtained, since with different feed rates different quantities of fuel are metered in the same metering interval.

Either the signal ASS or the signal FBSK is fed, via a selector 155, to the pump control 130. In one mode of operation, the signal ASS determines directly the start AB of actuation for the actuator 110. The signal ASS directly triggers the signal AB for driving the solenoid valve. In another mode of operation, as when the ASS signal fails, the desired value for the start of feeding FBSK, which is related to the crankshaft, serves as the input variable for calculating and generating the start of actuation in the pump control device.

Figure 2:
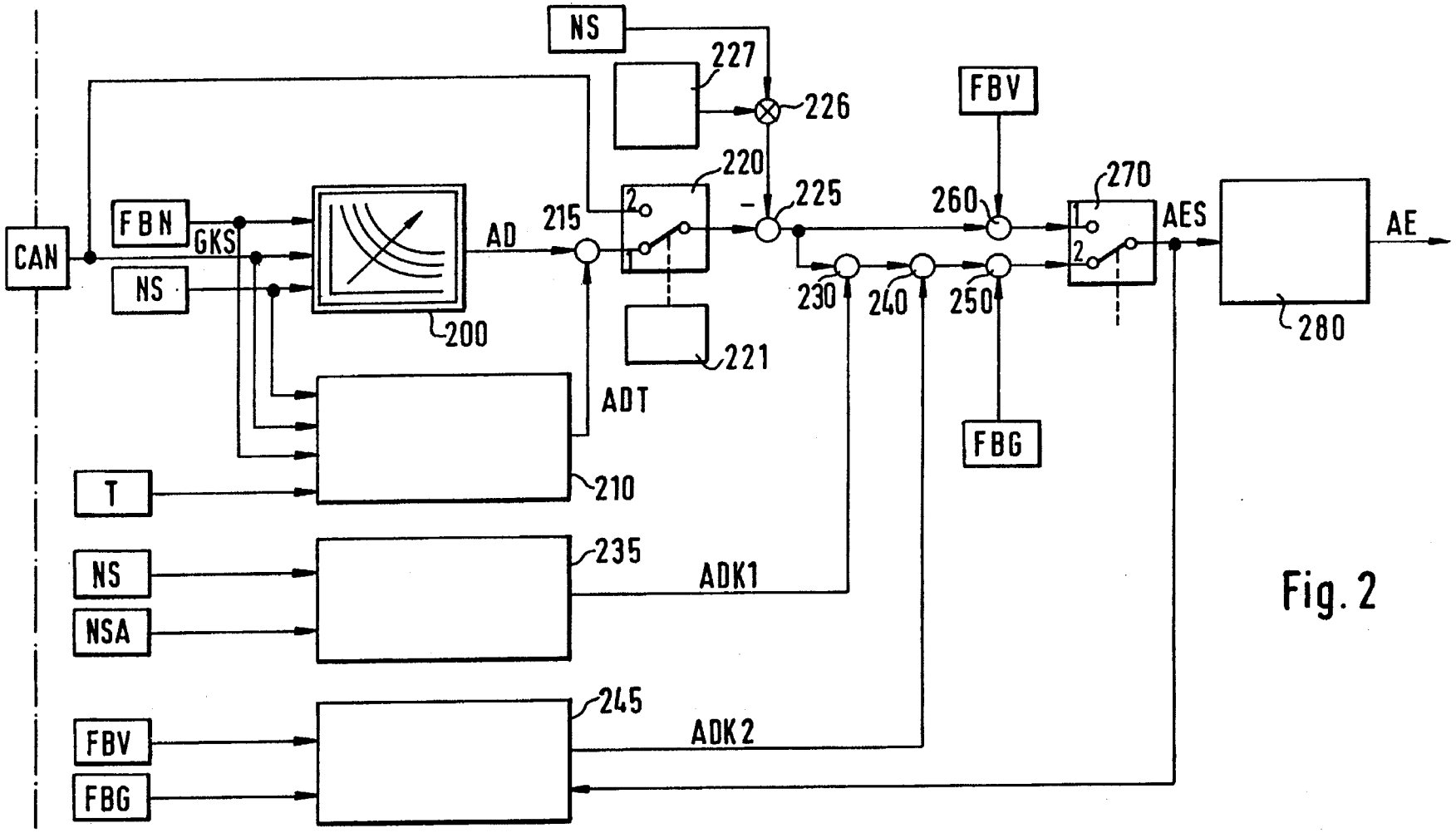
FIG. 2 illustrates the functional elements of a pump control device in accordance with the present invention.

In FIG. 2, the calculation of the end of actuation is represented, which is an essential part of the fuel rate controller 131. The desired value QKS for the quantity of fuel to be injected is provided, via the interface CAN, to a pump characteristic table 200. Furthermore, the start FBN of feeding, related to the camshaft, and a segment speed of revolution NS serve as input variables to the pump characteristic table 200. The pump characteristic table supplies the actuation period AD as an output variable.

The speed of revolution value which is detected by the sensor 142 is designated as a segment speed of revolution NS. This is a value which is averaged over a relatively large angular range of the crankshaft.

A temperature compensation device 210 is supplied with the same input variables as is the table 200 and, in addition, receives a temperature signal T from a temperature sensor. On the basis of these variables, the temperature compensation device 210 calculates a correction actuation period ADT. The correction actuation period ADT and the actuation period AD of the pump characteristic table 200 are logically connected to one another at a logic connection point 215. Preferably, the two variables are added or multiplied at the logical connection point 215.

The output signal of the logic connection point 215 is passed via a selector 220 to a logic connection point 225. The signal QKS relating to the desired quantity of fuel is applied to the second input of the selector 220. The selector 220 is controlled by a selection controller 221.

The output signal of a logic connection point 226 is fed with a negative sign to the second input of the logic connection point 225. At the logic connection point 226, the signals of the switching time setpoint selection device 227 and the segment speed of revolution NS are logically combined, preferably multiplicatively.

The output signal of the logic connection point 225 is passed via the logic connection points 230, 240 and 250 or directly via the logic connection point 260 to a selector 270. At the logic connection point 230, the output signal of the logic connection point 225 is logically combined with the output signal ADK1 of an acceleration correction device 235. The acceleration correction device 235 processes, as input signals, the segment speed of revolution NS and a more current value NSA of the segment speed of revolution.

The logic connection point 240 logically combines the output signal of the logic connection point 230 to the output signal ADK2 of a feed rate difference correction block 245 which processes, as input variables, a signal relating to the predicted start of feeding, the measured start of feeding and the end-of-drive signal AES. The logic connection point 250 combines the output signal of the logic connection point 240 with a signal FBG relating to the measured start of feeding.

The logic connection point 260 logically combines the output signal of the logic connection point 225 with a predicted start-of-feeding signal FBV. The selector 270 routes the output signal of the logic connection point 260 or the output signal of the logic connection point 250 to an end-of-actuation controller 280. The end-of-actuation controller 280 then supplies the first actuator with the end-of-drive signal AES.

The operation of the device of FIG. 2 will now be described.

The actuation period AD is read from the pump characteristic table 200 as a function of the desired injection quantity QKS, the start of feeding FBN related to the camshaft and the segment speed of revolution NS. Although the volume of fuel delivered is determined by the actuation period, control of the mass of fuel delivered is required for precise metering of the fuel. Therefore, the actuation period is adjusted by means of the temperature compensation device 210 on the basis of the temperature T of the fuel. For this purpose, the actuation period AD is logically combined with the correction value ADT at the logic connection point 215.

The calculation of the pump characteristic table requires a finite computing time. This leads to problems, particularly at high speeds of revolution. Since the signal ASS drives the solenoid valve directly in terms of starting the metering of fuel, it is possible for the end-of-drive signal to occur before the end of the calculation of the pump characteristic table for fuel. In particular, when the engine control device prescribes a zero quantity (no injection), unacceptable metering of fuel can occur. Therefore, in accordance with the present invention, provision is made for the selector 220 to use the signal QKS directly or the desired fuel quantity instead of the output signal AD of the pump characteristic table.

This is in particular the case if the engine control device prescribes very small quantity values, especially a zero quantity (no injection). In this case, the selector 220 is actuated in such a way that it assumes the position designated by 2 and the zero quantity signal is passed on directly to the end-of-actuation controller 280. The end-of-actuation controller 280 then immediately outputs the end-of-drive signal AES.

Preferably, the selection controller 221 includes a threshold value query facility which tests whether the quantity of fuel to be injected, or a corresponding signal such as the actuation period, exceeds a threshold value. The threshold value corresponds to a fuel quantity value which corresponds to an actuation period which is shorter or only slightly longer than the computing time for calculating the characteristic table 200.

It is particularly advantageous if the selector 220 can be actuated externally. Thus, for example for test purposes, the signal QKS can be used directly as the actuation period AD, thereby by-passing the pump characteristic table 200.

According to the present invention it is possible, with specific provisos, for the selector 220 to select the processed or the unprocessed fuel quantity signal QKS as the actuation period signal AD. As a result, it is possible to prevent unacceptable quantities of fuel from being injected in specific operating states, in particular in the case of a small load and high speeds of revolution.

Usually, a specific time elapses between the actuation and the reaction of the solenoid valve. This time is designated as the switching time of the solenoid valve. The actuation period signal AD is corrected at the logic connection point 225 with the solenoid valve switching time. The value for the switching time is stored in the switching time setpoint selection device 227. In the block 226, the switching time is logically combined with the segment speed of revolution NS. By multiplying the segment speed of revolution by the switching time, an angle which corresponds to the switching time of the solenoid valve is obtained. The actuation period is shortened by this angle at the logic connection point 225 and the feed period or metering period FD is thus obtained.

If the feed period is now added to the start of feeding, the desired value AES for the end of actuation is thus obtained. As soon as the value for the feed period is present at the output of the logic connection point 225, it is logically combined with the predicted value FBV for the start of feeding at the logic connection point 260, and the desired value AES for the end of actuation is thus calculated. This value which is calculated in this way is then stored in the selector 270.

The feed period value is corrected at the logic connection points 230 and 240 using the output signal ADK1 from the acceleration correction block 235 and the correction value ADK2 of the feed rate difference correction block 245. At points 230 and 240, the feed period is preferably corrected additively and/or multiplicatively. After being corrected, the feed period value is then logically combined at the logic connection point 250 with the measured start FBG of feeding. The end-of-actuation value AES is then available at the output of the logic connection point 250.

The above-described correction procedure requires a specific computing time which is not available in all operating states. In particular, the computing time is not sufficient at high speeds of revolution and with small fuel quantities. In this case, the selector 270 selects the desired value for the end of actuation calculated from the uncorrected actuation period and the predicted start of feeding, FBV.

At low speeds of revolution and/or with small fuel quantities, if there is sufficient computing time available, the selector 270 selects the desired value, which has been corrected in a complex way and calculated with the measured start FBG of feeding, for the end of actuation, AES.

In a particularly advantageous embodiment there is provision for the selector 270 to be realized as a memory. The output signals of the logic connection points 250 and 260 are stored in the memory of the selector 270 as soon as they are available. The end-of-actuation controller 280 then reads out the respective instantaneous value.

In the operating states in which the computing time is not sufficient, the output signal of the logic connection point 250 will not yet be available. In this case, the result of the logic connection point 260 is selected by the selector 270. In the operating states in which the computing time is sufficient, the output signal of the logic connection point 240 will be present. In this case, the result of the logic connection point 250 is selected by the selector 270.

Figure 3:
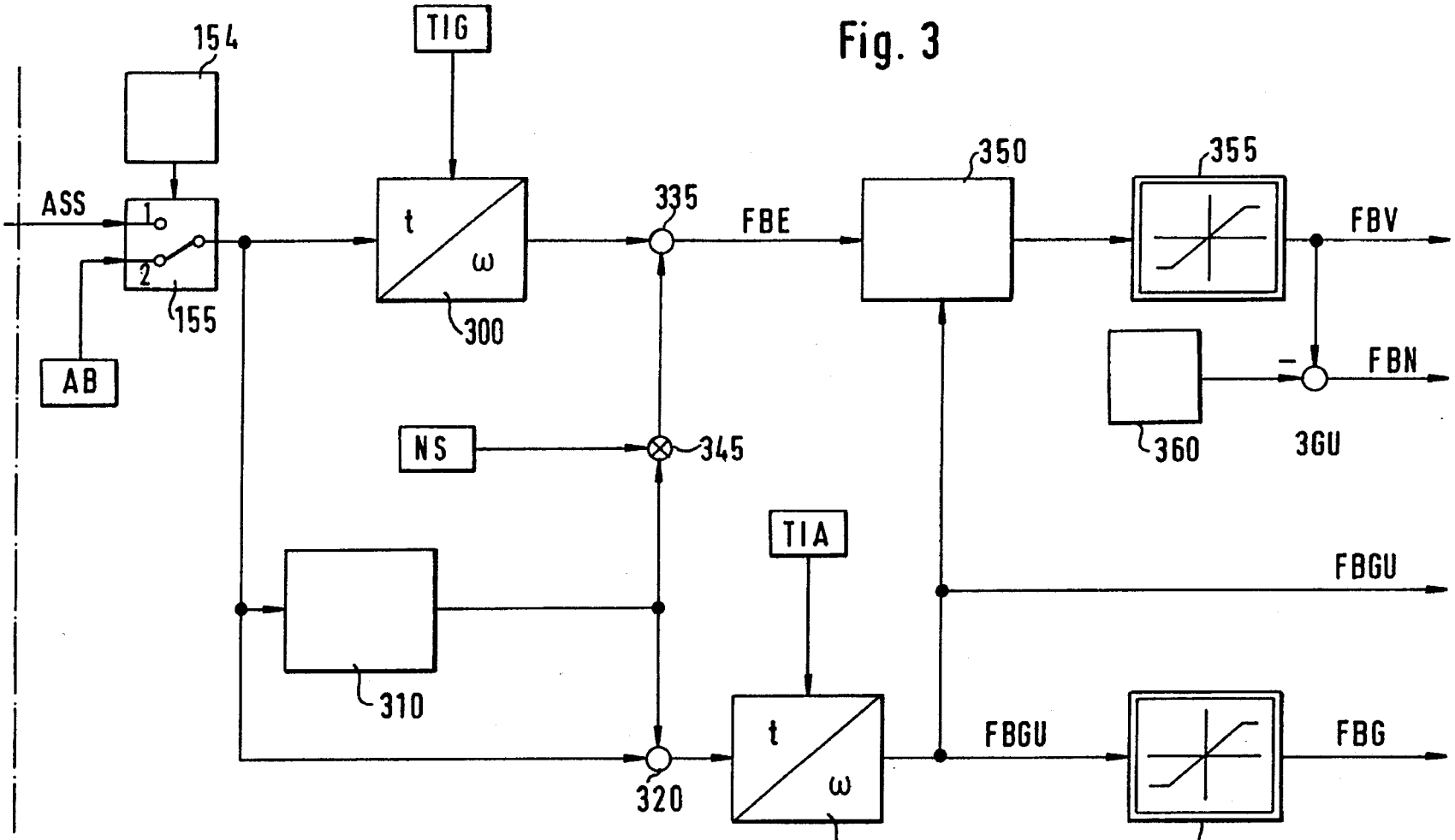
FIG. 3 shows a block diagram of a device for detecting the start of feeding.

In FIG. 3, the determination of the various start-of-feeding signals is illustrated. Using the selector 155, either the signal ASS or a signal which indicates the enabling of the solenoid valve is selected. In one mode of operation, a drive circuit 154 drives the selector 155 in such a way that it is in the position 1. In this case, the ASS signal which is prepared by the engine control device 51 is used. In another mode of operation, e.g., in the case of faults, the signal FBSK which is transferred via the CAN interface or a substitute signal which specifies the start of feeding or the start AB of actuation is used.

The output signal of the selector 155 is fed to an extrapolation device 300, a BIP evaluation block 310 and via a logic connection point 320 to an interpolation device 330. On the basis of the output signal of the selector 155, which corresponds to the solenoid valve switch-on time, and on the basis of the filtered increment time TIG, the extrapolation device 300 calculate an angle variable which is fed to the logic connection point 335.

The increment time TI is the time between two pulses of the increment wheel 136. The filtered increment time TIC is obtained, for example, by averaging over a plurality of increments.

The BIP evaluation block 310 feeds a logic connection point 345 whose output is applied to the second input of the logic connection point 335. In addition, the output signal of the BIP evaluation block 310 is provided to the logic connection point 320. At the logic connection point 345, the output signal of the BIP evaluation block 310 is logically combined with the segment speed of revolution NS. This logical combination preferably takes place multiplicatively. The segment speed of revolution NS, which corresponds to the instantaneous speed of revolution during one increment, is provided by the evaluation device 133.

The output signal FBE of the logic connection point 335 is provided to a start-of-feeding monitor 350. The output signal of the start-of-feeding monitor 350 is, in turn, provided to a limiter 355. The signal FBV, which corresponds to the supposed start of feeding, generated at the output of the limiter 355.

Furthermore, the output signal of the limiter 355 is logically combined at a logic connection point 3GU with a correction value, provided by block 360, relating to the installation tolerance between the camshaft and sensor shaft. A signal FBN which specifies the start of feeding, related to the camshafts, is present at the output of the logic connection point 3GU.

The output signal FBGU of the interpolation device 330 corresponds to the measured, non-limited start of feeding. The signal FBGU is passed on the one hand to the start-of-feeding monitor 350 and to a limiter 365. The output signal FBG of the limiter 365 specifies the measured start of feeding.

The device of FIG. 3 operates as follows. On the basis of the drive signal AB for the solenoid valve and on the basis of the filtered increment time TIG, the extrapolation device 300 calculates an angle variable which corresponds to the angular position of the camshaft at the time of the drive signal AB.

In addition, on the basis of the drive signal, the BIP evaluation device 310 specifies a time window within which the BIP evaluation device 310 detects the time of the closing of the solenoid valve. On the basis of the time AB of the actuation of the solenoid valve and of the reaction of the solenoid valve, the switching time of the solenoid valve is obtained. The value determined during the present metering is used for the next metering.

The angle through which the camshaft rotates between actuation and closing of the solenoid is obtained by multiplying the switching time of the solenoid valve by the segment speed of revolution NS, at the logic connection point 345. At the logic connection point 335, this angle is added to the angle calculated from the actuation time AB. On the basis of the resultant signal, FBE, relating to the extrapolated start of feeding, the start-of-feeding monitor 350, described in greater detail below, calculates the supposed start of feeding.

The limiter 355 limits the signal calculated by the start-of-feeding monitor 350 to acceptable values. By logic connection to the correction value, the start FBN of feeding related to the camshaft is obtained.

The supposed start of feeding FBV or FBN is available even before the corresponding metering. This is possible because the extrapolation device 300 calculates the value on the basis of the filtered increment time before metering.

The measured start FBG or FBGU of feeding is, in contrast, not available until it has been calculated at the time of the start of feeding by means of the interpolation device 330 using the present increment time TIA. The angular position of the camshaft at the start of feeding, which position is calculated by the interpolation device, is therefore not available until some time after the start of feeding. The output signal FBGU of the interpolation device 330 corresponds to the measured, non-limited start of feeding. By means of the limiter 365, the signal FBGU is limited to acceptable values. At the same time, the FBGU signal is fed to the start-of-feeding monitor 350.

The calculation, illustrated in FIG. 3, of the various start-of-feeding signals can also be transferred to the calculation of end-of-feeding signals. In this case, a supposed end of feeding FEV is calculated in a way corresponding to that in FIG. 3 for the start of feeding on the basis of the end-of-drive signal AF by means of an extrapolation taking into account the switching time of the solenoid valve and of an end-of-feeding monitor. After the end of feeding, a measured end of feeding FEG is determined by means of an interpolation corresponding to that illustrated in FIG. 3 for the start of feeding.

A conversion of a time variable into an angle variable takes place by means of an extrapolation before an event. After the event, the same time variable is then converted into a measured angle variable by means of an interpolation. The time variable is the start of feeding and/or the end of actuation.

Figure 4:
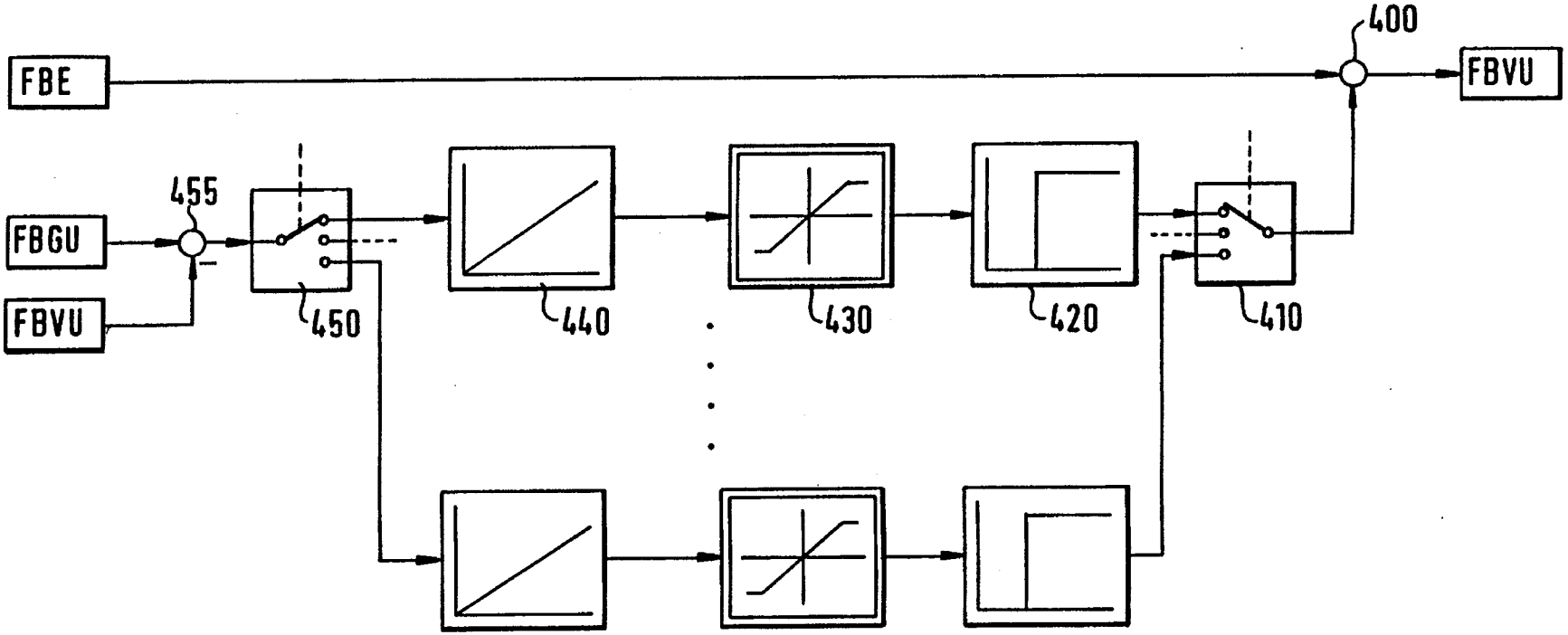
FIG. 4 shows a block diagram of a start-of-feeding monitor.

In FIG. 4, the start-of-feeding monitor 350 is illustrated in greater detail. The input signal FBE, which corresponds to the extrapolated start of feeding, is provided to a logic connection point 400, and the output signal FBVU of the point 400, which corresponds to the non-limited, supposed start of feeding, is provided as the output of the start-of-feeding monitor 350. The output signal of a selector 410 is provided as the second input of the logic connection point 400. One input of the selector 410 is coupled to the output signal of a delay element 420. The input of the delay element 420 is coupled to the output signal of a limiter 430. The output signal of an integrator 440 is coupled to the input of the limiter 430. The input of the integrator 440 is coupled via a selector 450 to the difference signal formed from the measured, non-limited start of feeding signal FBGU and the non-limited, supposed start of feeding signal FBVU. For this purpose, these two signals are logically combined by a logic connection point 455.

An integrator 440, a limiter 430 and a delay element 420 are provided for each cylinder. The selectors 450 and 410 assign each integrator/limiter/delay set to the corresponding cylinder of the internal combustion engine.

On the basis of the difference between the non-limited measured start of feeding FBGU and the non-limited, supposed start of feeding FBVU, the logic connection point 455 forms a deviation.

The selector 450 selects the corresponding integrator 440 which is assigned to the corresponding cylinder. The integrator integrates the difference between the two start of feeding values. The output signal of the integrator 440 is limited between upper and lower acceptable values by the limiter 430. The delay element 420 delays the limited signal by one revolution of the camshaft. As a result, during the next metering, the extrapolated start FBE of feeding is corrected at the logic connection point 400 by the output variable of the delay device 430 during the preceding metering for the same cylinder.

The start-of-feeding monitor 350 essentially constitutes a controller with integral behavior for each cylinder, which controller generates the extrapolated value for the start FBE of feeding and the difference between the measured and the supposed non-limited start of feeding.

Figure 5A:
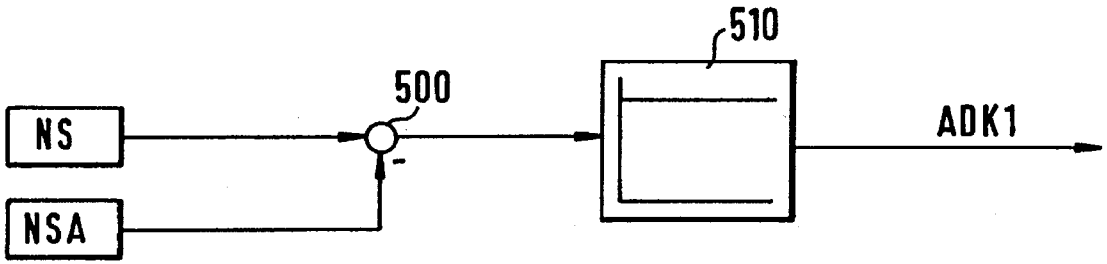
FIGS. 5*a* and 5*b* show block diagrams of two correction blocks.

In FIG. 5*a*, the acceleration correction block 235 is illustrated in greater detail. The segment speed of revolution NS and a more recent value for the segment speed of revolution NSA, which has been acquired at a later time, are fed to a logic connection point 500. This difference NB, which constitutes a measure of the acceleration of the internal combustion engine, is passed to an amplifier 510 at whose output the correction value ADK1 is generated. The difference between the present value for the segment speed of revolution NS and another value NSA for the segment speed of revolution is weighted in the amplifier 510 and is passed as a correction variable ADK1 to the logic connection point 230.

By means of the acceleration correction block 235, the influence of the change of the speed of revolution is taken into account. The calculation of the characteristic table 200 is very time-intensive since it is a multidimensional characteristic table. If the instantaneous speed of revolution changes between the calculation of the characteristic table and the metering of fuel, an excessively large or an excessively small quantity of fuel is metered. Therefore, there is provision for the amplifier 510 to be dimensioned in such a way that, as the speed of revolution rises, the feed period is reduced and, as the speed of revolution drops, the feed period is increased.

If the speed of revolution changes between the calculation of the extrapolated start FBE of feeding at the logic connection point 335 and the metering, a quantity fault is also produced and is also compensated by this correction.

It is particularly advantageous if the influence of the acceleration is overcompensated. This means that the correction is dimensioned in such a way that a correction value is selected which is too large for actual requirements.

The injected quantity of fuel depends essentially on the angle of the camshaft traversed during the actuation period.

Here, the quantity of fuel to be injected is dependent on the feed rate, that is to say on the quantity of fuel injected per unit angular displacement of the camshaft.

Usually, the feed rate is not constant but is rather a function of the angular position of the camshaft. This means that with an identical actuation period, different quantities of fuel are metered as a function of the start of feeding. Since the pump characteristic table has to be calculated at a very early time, only the supposed start of feeding FBVN, which is related to the camshaft, is available here. This value is merely extrapolated and therefore does not correspond to the actual or the measured start of feeding.

If the measured start FBG of feeding is still known before the end of metering, the fault which is based on the faulty start of feeding can be compensated by means of a corresponding correction by means of the feed rate difference correction block 245.

Figure 5B:
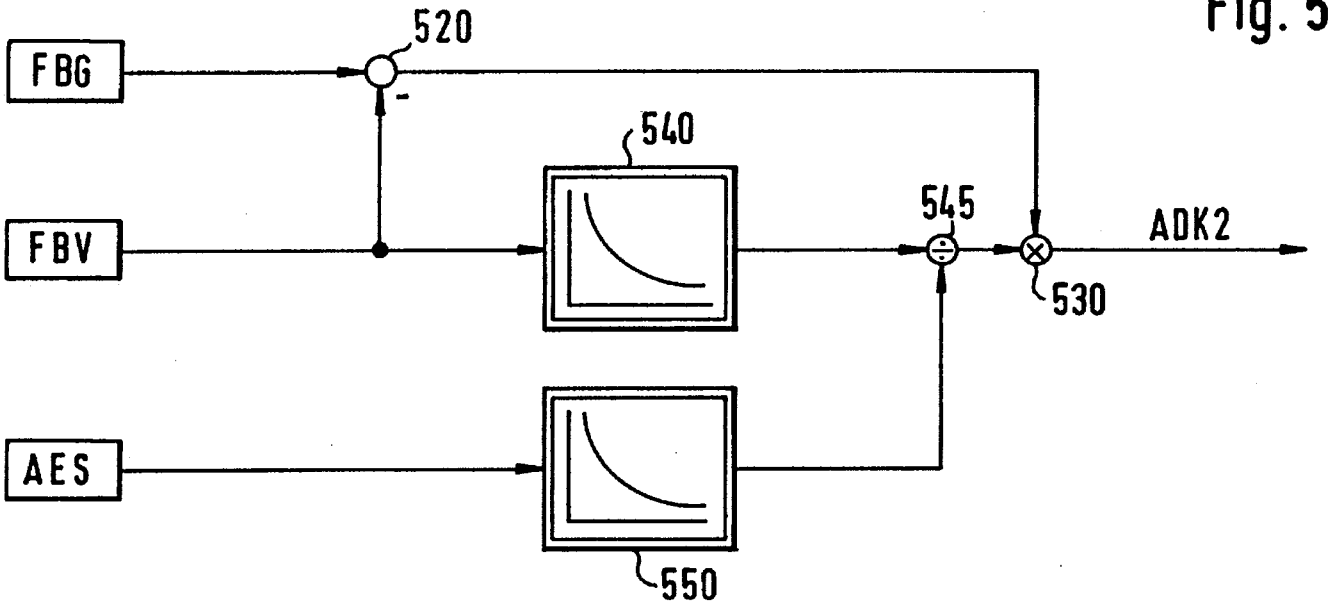

The feed rate difference correction block 245 is illustrated in FIG. 5*b* in greater detail. The measured start of feeding FBG is passed via a logic connection point 520 to a further logic connection point 530. The supposed start of feeding FBV is passed on the one hand with a negative sign to the logic connection point 520 and also to the second input of the logic connection point 530 via a characteristic table 540 and a logic connection point 545. The desired value AES for the end of actuation is also passed via a characteristic table 550 to the second input of the logic connection point 545.

In the characteristic tables 540 and 550, the feed rate is stored as a function of the position of the camshaft. The feed rate at the time of the start of feeding is stored in the characteristic table 540. The feed rate at the time of the desired value for the end of actuation AES is stored in the characteristic table 550. At the output of the logic connection point 545, the correction value is present which allows for the difference between the feed rate at the time of the supposed start of feeding FBV and the feed rate at the time of the end of actuation AES. At the logic connection point 530, this value is logically combined with the difference formed from the supposed start of feeding FBV and the measured start of feeding FBG. The signal ADK2, which is generated by the logic connection point 530, takes into consideration the error which occurs because of the error in the supposed start of feeding.

What is claimed is:

1. A method for controlling an internal combustion engine having at least one solenoid valve, wherein actuating the solenoid valve for an actuation period causes delivery of a desired fuel quantity and wherein an end of actuation of the solenoid valve is fixed by a signal, the method comprising the steps of:

determining the actuation period using a pump characteristic table, for a first operating state of the internal combustion engine;

determining the actuation period directly using the desired fuel quantity, for a second operating state of the internal combustion engine;

fixing the end of actuation of the solenoid valve using a corrected end-of-actuation signal, for the first operating state of the internal combustion engine; and fixing the end of actuation of the solenoid valve using an uncorrected end-of-actuation signal, for the second operating state of the internal combustion engine.

2. The method according to claim 1, wherein the desired quantity of fuel is used directly to determine the actuation period if the desired quantity of fuel is smaller than a threshold value.

3. The method according to claim 1, wherein:

the uncorrected end-of-actuation signal is generated on the basis of the actuation period and a signal relating to a start of fuel delivery; and the corrected end-of-actuation signal is generated for specific operating states.

4. The method according to claim 1, wherein the uncorrected and the corrected end-of-actuation signals are stored in a memory and are retrieved from the memory when required.

5. The method according to claim 1, further comprising the steps of:

determining a supposed angular variable by extrapolation before a start of fuel delivery and/or the end of actuation; and determining a measured angular variable by interpolation after the start of fuel delivery and/or the end of actuation.

6. The method according to claim 1, further comprising the step of correcting the actuation period in accordance with a change in a speed of revolution of the internal combustion engine.

7. The method according to claim 1, further comprising the step of correcting a rate of fuel delivery in accordance with a difference between a supposed angular variable and a measured angular variable.

8. The method according to claim 1, further comprising the step of correcting the delivery of fuel in accordance with an influence of a start of actuation and the end of actuation on a rate of fuel delivery.

9. A device for controlling an internal combustion engine having at least one solenoid valve, comprising:

means for prescribing an actuation period for the solenoid valve on the basis of at least one desired quantity of fuel, and for prescribing, on the basis of the actuation period, a signal for fixing an end of actuation of the solenoid valve;

means for determining the actuation period using a pump characteristic table, for a first operating state of the internal combustion engine;

means for directly determining the actuation period using the desired quantity of fuel, for a second operating state of the internal combustion engine;

means for fixing the end of actuation of the solenoid valve using a corrected end-of-actuation signal, for the first operating state of the internal combustion engine; and means for fixing the end of actuation of the solenoid valve using an uncorrected end-of-actuation signal, for the second operating state of the internal combustion engine.

* * * * *